US007909978B2

(12) United States Patent
Lodermeyer et al.

(10) Patent No.: US 7,909,978 B2
(45) Date of Patent: Mar. 22, 2011

(54) METHOD OF MAKING AN INTEGRATED CIRCUIT INCLUDING ELECTRODEPOSITION OF METALLIC CHROMIUM

(75) Inventors: Johannes Lodermeyer, Kinding (DE); Edmund Riedl, Gebelkofen (DE); Werner Robl, Regensburg (DE)

(73) Assignee: Infineon Technologies AG, Neubiberg (DE)

( * ) Notice: Subject to any disclaimer, the term of this patent is extended or adjusted under 35 U.S.C. 154(b) by 961 days.

(21) Appl. No.: 11/737,536

(22) Filed: Apr. 19, 2007

(65) Prior Publication Data

US 2008/0257743 A1 Oct. 23, 2008

(51) Int. Cl.

| | |
|---|---|
| ***C25D 3/04*** | (2006.01) |
| ***C25D 3/06*** | (2006.01) |
| ***C25D 3/10*** | (2006.01) |

(52) U.S. Cl. ..... 205/283; 205/287; 205/289; 205/290

(58) Field of Classification Search ..... 205/283, 205/287, 290, 289

See application file for complete search history.

(56) References Cited

U.S. PATENT DOCUMENTS

| | | | | |
|---|---|---|---|---|
| 2,750,334 | A * | 6/1956 | Brown | 205/290 |
| 4,406,756 | A * | 9/1983 | Baranyi | 205/290 |
| 4,588,481 | A * | 5/1986 | Chessin et al. | 205/290 |
| 4,718,993 | A * | 1/1988 | Cupta et al. | 361/748 |

* cited by examiner

*Primary Examiner* — Edna Wong

(74) *Attorney, Agent, or Firm* — Dicke, Billig & Czaja, PLLC

(57) ABSTRACT

A method of making an integrated circuit including a composition of matter for electrodepositing of chromium is disclosed. One embodiment provides a bath having a solution of a chromium salt in a substantially anhydrous organic solvent, to uses of certain chromium salts for electrodepositing and to processes for electrodepositing chromium.

16 Claims, 3 Drawing Sheets

Thick Black Chromium Layer

Fig. 1)
Thick Black Chromium Layer
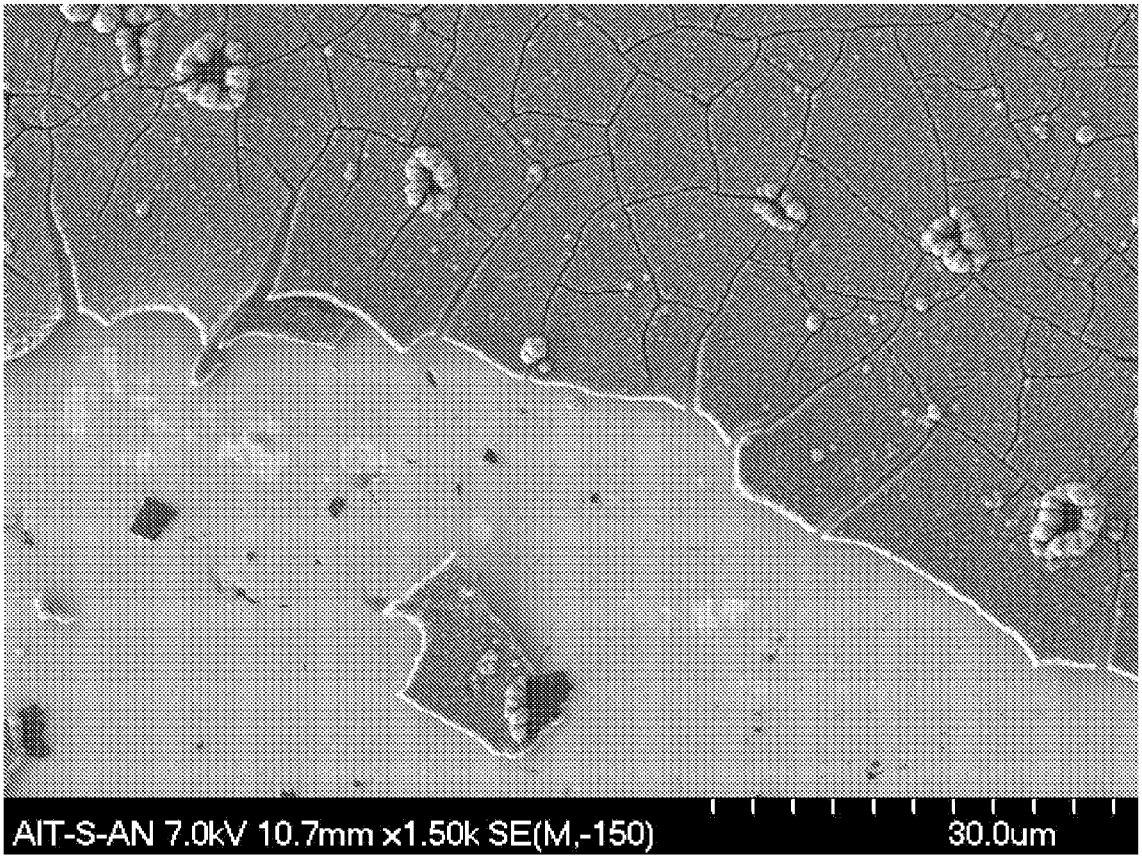

Fig. 2)
Thin Bright Chromium Layer
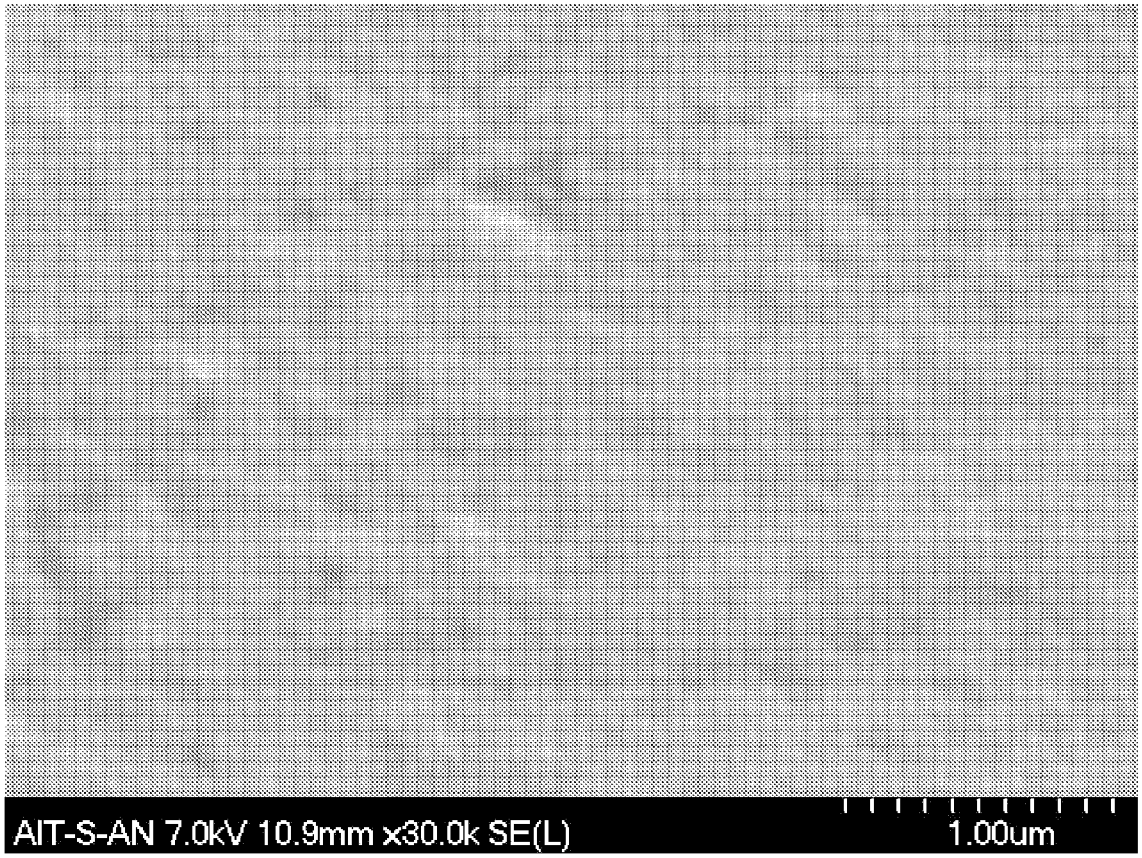

Fig. 3)
EDX: Bright Chromium Layer:
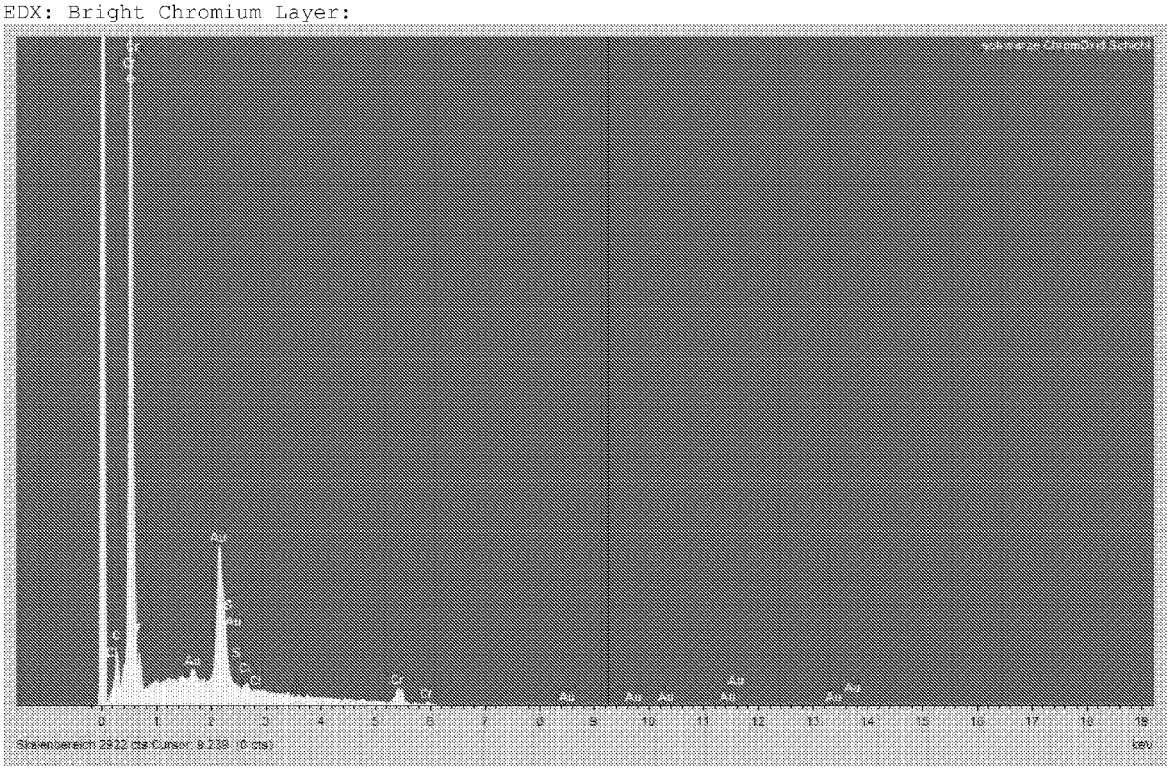

METHOD OF MAKING AN INTEGRATED CIRCUIT INCLUDING ELECTRODEPOSITION OF METALLIC CHROMIUM

BACKGROUND

The invention relates to a method of making an integrated circuit, including a composition of matter for electrodepositing of chromium, to uses of certain chromium salts for electrodepositing and to processes for electrodepositing chromium.

Chromium is a metal of high technical value based on its superior attributes. Coatings of chromium are highly resistant to corrosion and are showing great hardness, low abrasion, thermal resistance and a low coefficient of friction. Chromium is weather resistant and illustrates low tarnishing, is stable at temperatures up to 500° C. and is inert to most chemicals except hydrochloric acid and hot sulfuric acid.

Usually a chromium coating is used in two technical fields: a) decorative chromium-plating with layers up to 0.80 μm usually on a nickel surface, or b) functional chromium-plating with layers of more than 0.80 μm being usually electrodeposited directly on the surface for an increased hardness.

In addition, chromium may be electrodeposited as black chromium using high current density. These are layers rich in $Cr_2O_3$ used in the optical or electrical industry as well as for sun collectors.

Metallic chromium or compounds of chromium (III) are toxicologically harmless for humans whereas compounds of chromium (VI) are rated toxic and carcinogenic. The lethal dose of chromium (VI) after oral uptake is given in literature as 1 g/kg body weight (L. Roth, Giftmonographien—Chrom und Chromverbindungen, Ecomed, Landsberg, 1999). Chromic acid is damaging to the lungs and liver and has an etching effect on mucosas. During degradation of the chromium (VI) compounds in the body chromium (V) is formed as an intermediate, which is held responsible for the carcinogenic activity. Owing to that, electrodepositing from baths having Chromium (VI) is either forbidden in a large number of countries or may only be done under tight security measures.

Even though as described above the use of Chromium (VI) and its compounds is quite problematic it is still state of the art to electrodeposit chromium from baths having chromium (VI) compounds as reliable alternatives are still missing. All of these facts and disadvantages clearly indicate a strong need for improvement in the technical field of electrodepositing of chromium.

For these and other reasons, there is a need for the present invention.

SUMMARY

One embodiment provides a method of making an integrated circuit. One embodiment provides a composition of matter for electrodepositing chromium, including a bath having a solution of a chromium salt in a substantially anhydrous organic solvent. In one embodiment, the salts are salts of chromium (II) or chromium (III). An additional embodiment is the use of sulfonate salts of chromium (II) and chromium (III) according to general formula (I) for electrodepositing. The methylsulfonates, perfluormethylsulfontes or tosylsulfonates of chromium (II) or (III) are used. According to a third embodiment, a process for electrodepositing chromium from a bath having a solution of a chromium salt in a substantially anhydrous organic solvent is provided.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the description serve to explain the principles of the invention. Other embodiments of the present invention and many of the intended advantages of the present invention will be readily appreciated as they become better understood by reference to the following detailed description. The elements of the drawings are not necessarily to scale relative to each other. Like reference numerals designate corresponding similar parts.

FIG. 1 illustrates a scanning electron microscopic picture of electrodeposited chromium on copper as in the 1$^{st}$ experiment. Different areas (dark and bright) were achieved likely due to the organization of the bath/cell with a stirrer on top and the electrode on the bottom. The dark area illustrated here compared to the bright area is having a thicker dark chromium layer, but is also more brittle and showing more cracks. The layer in the bright area is thinner, more bright and more homogeneous. So it is clear that by choosing the right conditions different forms of layers can be achieved.

FIG. 2 illustrates a scanning electron microscopic picture of the thin bright chromium layer on copper as described above (FIG. 1).

FIG. 3 illustrates the EDX of the bright chromium layer in FIG. 2. An EDX (an energy dispersion x-ray) is a means for analyzing the elements of a certain sample by exciting the atoms by x-ray and measuring the energy of the excited particles. This EDX showed the purity and quality of the layer.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

One or more embodiments provide a method of making an integrated circuit, a semiconductor, or wafer, including a composition matter for electrodepositing of chromium.

According to one embodiment, a composition of matter for electrodepositing of chromium including a bath having a solution of a chromium salt in a substantially anhydrous organic solvent is provided.

The composition of matter according to one embodiment, as well as the other embodiments of this invention described below illustrates the big advantage of providing a new way of electrodepositing chromium from a bath without the high toxicological risks involved in the common processes with chromium (VI) and connected arrangements according to the state of the art. In addition the invention thus allows for a significantly less difficult technological access to this highly interesting technology. Besides that, the use of the substantially anhydrous organic solvent gives the advantage that the brittleness of the chromium layer due to the incorporation of chromium hydride is avoided as substantially no hydrogen is formed, avoiding thus also the need for a final thermal treatment (see above). Additionally the efficiency factor that can be reached by the embodiments of the invention is in the range of 50-80%, when using the substantially anhydrous organic solvent in certain cases/conditions of even >90%.

"Substantially anhydrous organic solvent" is as defined herein an organic solvent with a water content of equal to or less than 1% determined by the standard Karl-Fischer-Titration. It is further understood that the substantially anhydrous organic solvent can also be a mixture of different substantially anhydrous organic solvents.

"Bath" is defined herein as a composition of a container and a fluid comprised in the container in which chromium is present. By applying an electrical current by using a cathode and an anode to the fluid the chromium is electrodeposited from the bath thus chromium-plating a chosen surface.

In one embodiment, the chromium salt is dissolved in the substantially anhydrous organic solvent in a concentration of between 0.05 and 5 mol/kg of solvent or equal to or more than 1 mol/kg of solvent.

In another embodiment of the composition of matter the chromium salt is selected from salts of chromium (II) or chromium (III).

In another embodiment of the composition of matter the organic solvent is selected from aprotic organic solvents or from organic solvents not forming a strong complex with Cr (II) or Cr (III) or its respective salts or from organic solvents having a donator power of between 30 and 10, preferably of between 25 and 12, or from solvents in which the chromium salts may be dissolved.

It has to be understood that the organic solvents used may—but do not have to—also illustrate combinations of the attributes set out above. For reasons of stability of the chromium salts in the solvent especially aprotic solvents (not donating hydrogen bonds) are preferred. It is also possible if the organic solvent is not forming a strong complex with Cr (II) or Cr (III) or its respective salts stopping it from being reacted. This is partly predictable by the donator power but—due to the complicated nature of the solvent salt interactions—may not always be predictable by this characteristic. Nevertheless, this can easily be determined by someone skilled in the art using simple experiments. This is also true for determining solvents in which the chromium salts may be dissolved. These are preferred solvents and especially those in which the chromium salts may be completely dissolved in higher concentrations e.g., 5 mol/kg or—more preferably—2.5 mol/kg or 1 mol/kg. Donator power is a characteristic of a solvent well defined in literature (Gutmann V., *The Donor-Acceptor Approach to Molecular Interactions*, Plenum Press, New York, 1978).

In another embodiment of the composition of matter the organic solvent is selected from aprotic organic solvents, or from solvents in which the chromium salts may be dissolved, preferably from aprotic organic solvents in which the chromium salts may be dissolved.

In another embodiment of the composition of matter the substantially anhydrous organic solvent is provided in form of a mixture of different substantially anhydrous organic solvents. This is a mixed-solvents-approach.

In another embodiment of the composition of matter the organic solvent has a water content of less than 1% preferably of equal to or less than 0.5%, more preferably of equal to or less than 0.25%, most preferably of equal to or less than 0.15%. This may be determined using the standard Karl-Fischer-Titration.

In another embodiment of the composition of matter the organic solvent is selected from polar aprotic solvents, or non-polar solvents.

In a further embodiment of the composition of matter the organic solvent is selected from Acetonitril, Dimethylformamide (DMF), Tetrahydrofuran (THF), 1,4-Dioxane, Acetone, Dimethylsulfoxide; preferably from Acetonitril, Dimethylformamide (DMF), Tetrahydrofuran (THF);

Alkyl-alkyl ethers, carbonates, or carboxylic acid esters; preferably from tert.butyl-methyl ether, dimethyl carbonate, propylene glycol carbonate (4-Methyl-1,3-dioxolan-2-on), ethyl acetate.

In another embodiment of the composition of matter the anion in the chromium salt is selected from anions of general formula I

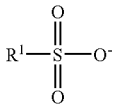

wherein $R^1$ is selected from optionally at least mono substituted $C_{1-4}$alkyl, or tosyl (p-toluenesulfonate ester);

homologuous alcoholate anions; or a strongly electron-withdrawing group.

"Alkyl" is defined as an univalent radical consisting of carbon and hydrogen atoms arranged in a optionally branched chain. Thus, "alkyl" is understood as meaning a saturated, linear or branched chain of hydrocarbons, which can be unsubstituted or mono- or polysubstituted. In these, $C_{1-4}$-alkyl represents C1-, C2-, C3- or C4-alkyl, so methyl, ethyl, propyl or butyl, if substituted also $CHF_2$, $CF_3$ or $CH_2OH$ etc.

The term substituted in the context of this invention is understood as meaning replacement of at least one hydrogen radical by F, Cl, Br, I, $NH_2$, SH or OH, "polysubstituted" (more than once substituted) being understood as meaning that the replacement takes effect both on different or on the same atoms several times with the same or different substituents, for example three times on the same C atom, as in the case of $CF_3$, or at different places, as in the case of e.g., — . . . CH(OH)—$CH_2$—$CH_2$—$CHCl_2$. "Optionally at least monosubstituted" means either "monosubstituted", "polysubstituted" or—if the option is not fulfilled—"unsubstituted".

"Alcoholate" is the salt between the chromium and an alcohol, preferably a homologous alcohol, preferably a halogenated alcohol. Examples include methanolate, ethanolate, propanolate or butanolate or their halogenated derivatives.

An "Electron withdrawing group" or EWG draws electrons away from a reaction center. Examples include pentahalogenated benzoate etc.

In another embodiment of the composition of matter the anion in the chromium salt is selected from anions of general formula I

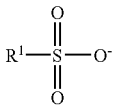

wherein $R^1$ is selected from $CH_3$, $CF_3$, $CCl_3$, or Tosyl;

homologuous alcoholate anions, with the alcohols selected from halogenated methanol, ethanol, propanol, butanol; preferably from halogenated methanol, iso-propanol, n-propol, iso-butanol, n-butanol; or a strongly electron-withdrawing group, selected from penta-halogenated benzoate, preferably from $C_6F_5COO^-$, or $C_6Cl_5COO^-$.

In another embodiment, the bath is additionally having at least one further electrolyte, preferably a nonaqueous electrolyte, more preferably a phosphate, alkyl-sulfonate, borate, antimonite or arsenate; most preferably the electrolyte is selected from hexafluorophosphates, tris(pentafluoroethyl) trifluorphosphate, methanesulfonates, trifluoromethanesulfonates, tetrafluoroborates, bis[oxalato(2-)]borate, bis[silicylato(2-)]borate, bis[1,2-benzenediolato(2-)-0,0'] borate, hexafluoroanitmonate, or hexafluoroarsenate; or is selected from hexafluorophosphates, or tetrafluoroborates.

An "electrolyte" as defined here is a substance containing a free ion that behaves as an electrical conductor medium. Examples include especially salts, and include nonaqueous electrolytes, preferably those also known in the technical field of dry batteries or dry cell batteries. Examples are phosphates, alkyl-sulfonates, borates, antimonites or arsenates.

Another embodiment of the composition of matter is additionally having an anode and cathode; also preferably an insoluble anode; more preferably a titanium, a nickel or a platinum anode; even more preferably a palladium, iridium or mixed metal oxide (MMO) coated titanium anode or a nickel or platinum anode.

"Anode" and "cathode" are both electrodes through which electric current flows into a polarised electrical device, like a solution having electrolytes, like chromium salts. An "Insoluble anode/electrode" is well defined in the art and briefly is an electrode being stable in the surrounding solution/fluid under circumstances of applied electrical current. Examples include palladium, iridium or mixed metal oxide (MMO) coated titanium anodes.

In another embodiment of the composition of matter the anode and the cathode are arranged at least partly inside the solution comprised within the bath, preferably while no physical barrier or membrane is blocking the flow of the anhydrous organic solvent between the cathode and anode.

This embodiment is specifically drawn to an undivided arrangement of the cell/bath in the composition of matter according to the invention.

In another embodiment of the composition of matter the composition does also include a means for excluding oxygen or humidity or both from the bath, preferably from the surface of the bath or of the solution comprised within the bath; preferably in the form of a sealing, or lid covering the surface of the bath or solution comprised within the bath or a means for introducing a protective gas to the surface of the bath or solution comprised within the bath; or combinations thereof.

"Lid" and "sealing" refers to different means for closing the area including the bath, or more precisely the surface of the solvent comprised in the bath of the composition of matter according to the invention against incursion of gases or e.g., humidity. Especially this is to be understood as preferably providing a closed system. On the other hand another commonly used approach to exclude incursion of oxygen, or humidity is the use of protective gases occupying the space above the surface of a reaction mixture, e.g., the solution comprised in the bath. Means for introducing a protective gas include e.g., different valves or orifices through which the protective gas may be applied etc., with the protecting gas then preferably being confined to the space above the solution by e.g., a lid or a sealing, which would then also serve to further exclude incursion of gases or humidity.

Another embodiment is the use of chromium (II) or chromium (III) salt with an anion according to general formula I

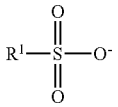

wherein $R^1$ is selected from optionally at least mono substituted $C_{1-4}$Alkyl, or toluoyl (p-toluene) for electrodepositing chromium.

In another embodiment of the use in general formula I $R^1$ is selected from $CH_3$, $CF_3$, $CCl_3$, or toluoyl.

In another embodiment of the use the electrodepositing of chromium is electrodepositing from a bath having a solution of the chromium (II) or chromium (III) salt in an anhydrous solvent.

In another embodiment of the use the chromium is electrodeposited on a conductive surface, preferably a conductive surface selected from metals, alloys of metals and conductive polymers.

A "conductive surface" in the sense of this invention is the surface of an item which surface is able to conduct an electric current. Examples include i.e. the metal-coated surface of a wafer (see below).

In another embodiment of the use the chromium is electrodeposited for the purpose of pattern plating or for the purpose of replacing sputtering on or for creating a conductive surface, or for creating a metal surface for soldering and layering.

"Sputtering" as defined herein is a process whereby atoms in a solid target material are ejected into the gas phase due to bombardment of the material by energetic ions. It is commonly used for thin film deposition like e.g., the sputtering of a wafer (see below) with metal to create a conductive surface.

Another embodiment provides a process for electrodepositing of chromium from a bath, wherein by using an electrode and an anode being arranged at least partly inside the bath an electric current is applied to the bath having a solution of a chromium salt in a substantially anhydrous organic solvent.

In another embodiment of the process the electric current is applied in a continuous way of a direct current as a DC-Process or in varying strengths as pulses as a pulse-plating.

In another embodiment of the process the anode is an insoluble anode; more preferably a titanium, a nickel or a platinum anode; even more preferably a palladium, iridium or mixed metal oxide (MMO) coated titanium anode or a nickel or platinum anode.

In another embodiment of the process no physical barrier or membrane is blocking the flow of the organic solvent between the cathode and anode.

In another embodiment, oxygen, humidity or both are excluded from the surface of the bath or of the solution comprised within the bath; preferably by using a sealing, or lid covering the surface of the bath or of the solution comprised within the bath or a means for introducing a protective gas to the surface of the bath or of the solution comprised within the bath; or combinations thereof.

In another embodiment of the process the chromium salt in the bath is selected from salts of chromium (II) or chromium (III).

In another embodiment of the process the organic solvent is selected from aprotic organic solvents or from organic solvents not forming a complex with Cr (II) or Cr (III) or its respective salts or from organic solvents having a donator power of between 30 and 10, preferably of between 25 and 12, or from solvents in which the chromium salts may be dissolved.

In another embodiment of the process the organic solvent is selected from aprotic organic solvents, or from solvents in which the chromium salts may be dissolved, preferably from aprotic organic solvents in which the chromium salts may be dissolved.

In another embodiment of the process the substantially anhydrous organic solvent is provided in form of a mixture of different substantially anhydrous organic solvents. This is a mixed-solvents-approach.

In another embodiment of the process the organic solvent has a water content of less than 1% preferably of equal to or less than 0.5%, more preferably of equal to or less than 0.25%, most preferably of equal to or less than 0.15%. This may be determined using the standard Karl-Fischer-Titration.

In another embodiment of the process the organic solvent is selected from polar aprotic solvents, or non-polar solvents.

In another embodiment of the process the organic solvent is selected from

Acetonitril, Dimethylformamide (DMF), Tetrahydrofuran (THF), 1,4-Dioxane, Acetone, Dimethylsulfoxide; preferably from Acetonitril, Dimethylformamide (DMF), Tetrahydrofuran (THF);

Alkyl-alkyl ethers, carbonates, or carboxylic acid esters; preferably from tert.butyl-methyl ether, dimethyl carbonate, propylene glycol carbonate (4-Methyl-1,3-dioxolan-2-on), ethyl acetate.

In another embodiment of the process the anion in the chromium salt is selected from anions of general formula I

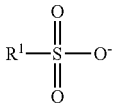

wherein $R^1$ is selected from optionally at least mono substituted $C_{1-4}$Alkyl, or Toluyl (p-toluene);

alcoholate anions; or a strongly electron-withdrawing group, preferably is selected from anions of general formula I

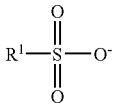

wherein $R^1$ is selected from $CH_3$, $CF_3$, or Tosyl;

homologuous alcoholate anions, with the alcohols selected from halogenated methanol, ethanol, propanol, butanol; preferably from halogenated methanol, iso-propanol, n-propol, iso-butanol, n-butanol; or a strongly electron-withdrawing group, selected from penta-halogenated benzoate, preferably from $C_6F_5COO^-$, or $C_6Cl_5COO^-$.

In another embodiment, the bath is additionally having at least one further electrolyte, preferably a nonaqueous electrolyte, more preferable a phosphate, alkyl-sulfonate, borate, antimonite or arsenate; most preferably is selected from hexafluorophosphates, tris(pentafluoroethyl)trifluorphosphate, methanesulfonates, trifluoromethanesulfonates, tetrafluoroborates, bis[oxalato(2-)]borate, bis[silicylato(2-)]borate, bis[1,2-benzenediolato(2-)-0,0']borate, hexafluoroanitmonate, or hexafluoroarsenate; or is selected from hexafluorophosphates, or tetrafluoroborates.

One or more embodiments may be used for various uses of high practical value, including processes for making integrated circuits and semiconductor devices. These include electrodepositing of chromium on a wafer. A wafer is a thin slice of a preferably semiconductive material, such as e.g., a silicon crystal, used in microelectronics, upon which e.g., microcircuits may be constructed by various means. In this the various attributes of chromium may be put to use including its barrier effect especially building barriers against diffusion in metallization for soldering. Other possible uses include metallization for soldering itself and the use as an initial layer in a process involving an epitactical building-up of layers of metal.

In addition, one more embodiments may be used in the electrodepositing in nanoporous layers especially as an adhesive layer. This may be done in an analogous way to the A2 electrolyte (Zn/Cr oxide) preferably substituting the toxic chromium (VI). Also, especially the chromium sulfonate salts used according to the invention may substitute the chromium (VI) from the A2-electrolyte in electrodepositing from—in this exceptionally case—aqueous solutions.

EXPERIMENTAL PART $1^{st}$ experiment: A bath with a solution of 0.5 mol/kg $Cr(CF_3SO_3)_x$ in substantially anhydrous DMF (Dimethylformamide) was prepared and subjected to an electronic current with a current density j of −10 mA/cm$^2$ by using an anode and a cathode at room temperature. The chromium was prepared as chromium (II) but chromium (III) will also be present. The chromium was electrodeposited on copper. The results can be seen in FIGS. 1 to 3.

$2^{nd}$ experiment: A bath with a solution of 0.5 mol/kg $Cr(CF_3SO_3)_x$ in substantially anhydrous DMF (Dimethylformamide) was prepared and subjected to an electronic current with a current density j of −10 mA/cm$^2$ by using an anode and a cathode at room temperature. The chromium was prepared as chromium (II) but chromium (III) will also be present. The chromium was electrodeposited on gold.

Although specific embodiments have been illustrated and described herein, it will be appreciated by those of ordinary skill in the art that a variety of alternate and/or equivalent implementations may be substituted for the specific embodiments illustrated and described without departing from the scope of the present invention. This application is intended to cover any adaptations or variations of the specific embodiments discussed herein. Therefore, it is intended that this invention be limited only by the claims and the equivalents thereof.

What is claimed is:

1. A composition of matter for electrodepositing chromium, the composition comprising a solution of a chromium salt in a substantially anhydrous organic solvent, the chromium salt comprising a halogenated alcoholate anion.

2. The composition of claim 1 wherein the chromium salt comprises a salt of chromium (II) or a salt of chromium (III).

3. The composition of claim 1 wherein the halogenated alcoholate anion is selected from halogenated methanol, halogenated ethanol, halogenated propanol, or halogenated butanol.

4. The composition of claim 3 wherein the halogenated alcoholate anion is selected from halogenated methanol, halogenated iso-propanol, halogenated n-propol, halogenated iso-butanol, or halogenated n-butanol.

5. The composition of claim 1 wherein the organic solvent is selected from a first organic solvent that is aprotic, a second organic solvent that does not form a complex with the chromium salt or with the chromium of the chromium salt, a third organic solvent having a donator power of between 30 and 10, a fourth organic solvent in which the chromium salt may be dissolved, or any combination of any of these.

6. The composition of claim 1 wherein the organic solvent contains less than 1% water.

7. The composition of claim 1 wherein the organic solvent comprises a polar aprotic solvent, a non-polar solvent, or a mixture of these.

8. The composition of claim 1 wherein the organic solvent is selected from the group consisting of acetonitrile, tetrahydrofuran (THF), dimethylformamide, 1,4-dioxane, acetone, dimethylsulfoxide, an alkyl-alkyl ether, a carbonate, a carboxylic acid ester, and any combination of any of these.

9. The composition of claim 8 wherein:

the alkyl-alkyl ether is tert.butyl-methyl ether;

the carbonate is selected from the group consisting of dimethyl carbonate, propylene glycol carbonate, 4-methyl-1,3-dioxolan-2-on, and any combination of these; and the carboxylic acid ester is from ethyl acetate.

10. The composition of claim 9 wherein the organic solvent is selected from acetonitrile, tetrahydrofuran (THF), dimethylformamide, the alkyl-alkyl ether, the carbonate, the carboxylic acid ester, or any combination of any of these.

11. The composition of claim 1 wherein the chromium salt is present in the solution in a concentration ranging from as low as 0.05 mol/kg of the organic solvent to as high as 5 mol/kg of the organic solvent.

12. The composition of claim 1 wherein the solution further comprises an electrolyte.

13. The composition of claim 12 wherein the electrolyte is nonaqueous.

14. The composition of claim 12 wherein the electrolyte is selected from a phosphate, an alkyl-sulfonate, a borate, an antimonite, or an arsenate.

15. The composition of claim 14 wherein the electrolyte is selected from hexafluorophosphate, tris(pentafluoroethyl)trifluorophosphate, methanesulfonate, trifluoromethanesulfonate, tetrafluoroborate, bis[oxalato(2-)]borate, bis[silicylato(2-)]borate, bis[1,2-benzenediolato(2-)-0,0']borate, hexafluoroantimonate, or hexafluoroarsenate.

16. A composition of matter for electrodepositing chromium, the composition comprising a solution of a chromium salt in a substantially anhydrous organic solvent, the chromium salt comprising a penta-halogenated benzoate selected from $C_6F_5COO^-$ or $C_6Cl_5COO^-$.

* * * * *